US008147124B1

(12) United States Patent
Glanville

(10) Patent No.: US 8,147,124 B1
(45) Date of Patent: Apr. 3, 2012

(54) STATIC MIXER

(76) Inventor: Robert W Glanville, Bristol, RI (US)

( * ) Notice: Subject to any disclaimer, the term of this patent is extended or adjusted under 35 U.S.C. 154(b) by 76 days.

(21) Appl. No.: 12/924,955

(22) Filed: Oct. 8, 2010

Related U.S. Application Data

(60) Provisional application No. 61/278,763, filed on Oct. 9, 2009.

(51) Int. Cl.
*B01F 5/00* (2006.01)

(52) U.S. Cl. ..... 366/338; 138/40

(58) Field of Classification Search ..... 366/337, 366/338; 138/40, 42, 44
See application file for complete search history.

(56) References Cited

U.S. PATENT DOCUMENTS

| | | | | |
|---|---|---|---|---|
| 1,706,145 | A * | 3/1929 | Collins | 138/40 |
| 2002/0031046 | A1 * | 3/2002 | Schneider et al. | 366/181.5 |
| 2002/0036951 | A1 * | 3/2002 | Brunet et al. | 366/337 |

* cited by examiner

*Primary Examiner* — David Sorkin
(74) *Attorney, Agent, or Firm* — Robert J. Doherty

(57) ABSTRACT

A static mixing device for mounting or other attachment within a hollow tubular conduit including a plurality of vanes generally equally spaced therein and each including a generally oblong plate radially inwardly extending from the conduit internal wall surface and wherein each of said plates is provided with a generally wing-shaped cap that downwardly, rearwardly and inwardly bends from the top of the plate to said conduit wall.

8 Claims, 9 Drawing Sheets

WESTFALL MANUFACTURING CO.

HEADLOSS CHART

*pipe ID* *6.07* *inches*

| GPM | CFS | ft/s | MODEL 2800 0.7 BETA psi Head loss | MODEL 2800 0.8 BETA psi Head loss | MODEL 2800 0.9 BETA psi Head loss | MODEL 3050 SINGLE psi Head loss | MODEL 3050 DOUBLE psi Head loss | MODEL 3050 TRIPLE psi Head loss |
|---|---|---|---|---|---|---|---|---|
| 100 | 0.223 | 1.11 | 0.27 | 0.11 | 0.06 | 0.005 | 0.003 | 0.014 |
| 200 | 0.446 | 2.22 | 1.08 | 0.45 | 0.22 | 0.018 | 0.037 | 0.054 |
| 300 | 0.668 | 3.33 | 2.42 | 1.01 | 0.50 | 0.041 | 0.084 | 0.122 |
| 400 | 0.891 | 4.43 | 4.31 | 1.80 | 0.90 | 0.074 | 0.149 | 0.217 |
| 500 | 1.114 | 5.54 | 6.74 | 2.82 | 1.40 | 0.115 | 0.234 | 0.339 |
| 600 | 1.337 | 6.65 | 9.70 | 4.06 | 2.02 | 0.166 | 0.336 | 0.488 |
| 700 | 1.560 | 7.76 | 13.20 | 5.52 | 2.75 | 0.226 | 0.458 | 0.664 |
| 800 | 1.782 | 8.87 | 17.24 | 7.21 | 3.59 | 0.295 | 0.598 | 0.868 |
| 900 | 2.005 | 9.98 | 21.82 | 9.13 | 4.54 | 0.373 | 0.757 | 1.098 |
| 1000 | 2.228 | 11.08 | 26.94 | 11.27 | 5.61 | 0.460 | 0.934 | 1.356 |
| 1100 | 2.451 | 12.20 | 32.60 | 13.63 | 6.78 | 0.557 | 1.130 | 1.640 |
| 1200 | 2.674 | 13.30 | 38.79 | 16.22 | 8.07 | 0.663 | 1.345 | 1.952 |

| m3/hr | m3/s | m/s | 0.7 BETA kg/cm2 head loss | 0.8 BETA kg/cm2 head loss | 0.9 BETA kg/cm2 head loss | MODEL 3050 SINGLE kg/cm2 | MODEL 3050 DOUBLE kg/cm2 | MODEL 3050 TRIPLE kg/cm2 |
|---|---|---|---|---|---|---|---|---|
| 23 | 0.0063 | 0.338 | 0.019 | 0.008 | 0.004 | 0.0003 | 0.0007 | 0.0010 |
| 45 | 0.0126 | 0.676 | 0.076 | 0.032 | 0.016 | 0.0013 | 0.0026 | 0.0038 |
| 68 | 0.0189 | 1.014 | 0.171 | 0.071 | 0.036 | 0.0029 | 0.0059 | 0.0086 |
| 91 | 0.0252 | 1.352 | 0.303 | 0.127 | 0.063 | 0.0052 | 0.0105 | 0.0153 |
| 114 | 0.0316 | 1.689 | 0.474 | 0.198 | 0.099 | 0.0081 | 0.0164 | 0.0239 |
| 136 | 0.0379 | 2.027 | 0.683 | 0.286 | 0.142 | 0.0117 | 0.0237 | 0.0344 |
| 159 | 0.0442 | 2.365 | 0.929 | 0.389 | 0.193 | 0.0159 | 0.0322 | 0.0468 |
| 182 | 0.0505 | 2.703 | 1.214 | 0.508 | 0.253 | 0.0207 | 0.0421 | 0.0611 |
| 204 | 0.0568 | 3.041 | 1.536 | 0.642 | 0.320 | 0.0263 | 0.0533 | 0.0773 |
| 227 | 0.0631 | 3.379 | 1.897 | 0.793 | 0.395 | 0.0324 | 0.0658 | 0.0954 |
| 250 | 0.0694 | 3.717 | 2.295 | 0.960 | 0.477 | 0.0392 | 0.0796 | 0.1155 |
| 273 | 0.0757 | 4.055 | 2.731 | 1.142 | 0.568 | 0.0467 | 0.0947 | 0.1374 |

FIG. 10

STATIC MIXER

Applicant claims the benefit of U.S. Provisional Patent Application Ser. No. 61/278,763 filed Oct. 9, 2009.

BACKGROUND OF THE INVENTION

This application pertains to mixers and particularly static mixers having fixed position structural elements that are generally mounted within a length of pipe such that fluids passing through such pipe may be effectively mixed or blended with a wide variety of additives. Such mixers have widespread use such as in municipal and industrial water treatment, chemical blending and chlorination/de-chlorination facilities. A highly effective commercially available mixer of this general type is described in applicant's previous U.S. Pat. No. 5,839,828 issued Nov. 24, 1998 to Robert W. Glanville. The device disclosed in such patent operates in part by creating trailing vortices which produce effective mixing in the fluid stream. The teachings of U.S. Pat. No. 5,839,828 are hereby incorporated into the present specification by specific reference thereto.

Despite the availability of adequate mixing devices such as described in the above patent, there is a both a need and desire to achieve the same or better mixing outcome with lower head loss and to accomplish such in the shortest distance downstream from the mixing device. A further object of this invention is the provision of such a device that accomplishes these objectives in a manner that is inexpensive, easy to fabricate from a wide variety of materials and operates in a trouble free manner.

These and other objects are accomplished by the provision of a static mixing device positioned in a conduit and within a fluid stream having a longitudinal flow direction with a passageway, comprising a plurality of mixing vane members forming a set thereof, said vanes spaced generally circumferentially equidistantly within a conduit and radially inwardly extending from a conduit internal wall surface towards the center of a conduit, each of said vane members including a generally oblong plate of planar extent with a generally straight base edge attached to an internal conduit wall and further including a leading edge upstanding from a base edge forward portion to a peak from which, in turn, a rearwardly downwardly curved trailing edge extends and terminates proximal the rear portion of said base edge, each of said plates including a generally triangularly-shaped cap attached and conforming to said curved trailing edge thereof with the cap apex aligned with said leading edge peak so as to form cap undersurfaces and cap top surfaces.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 10 is a head loss chart comparing head loss of three differently sized models of the mixing device described in U.S. Pat. No. 5,839,828 with the present invention having single, double and triple sets of mixing vanes.

DETAILED DESCRIPTION OF THE INVENTION

Figure 1:
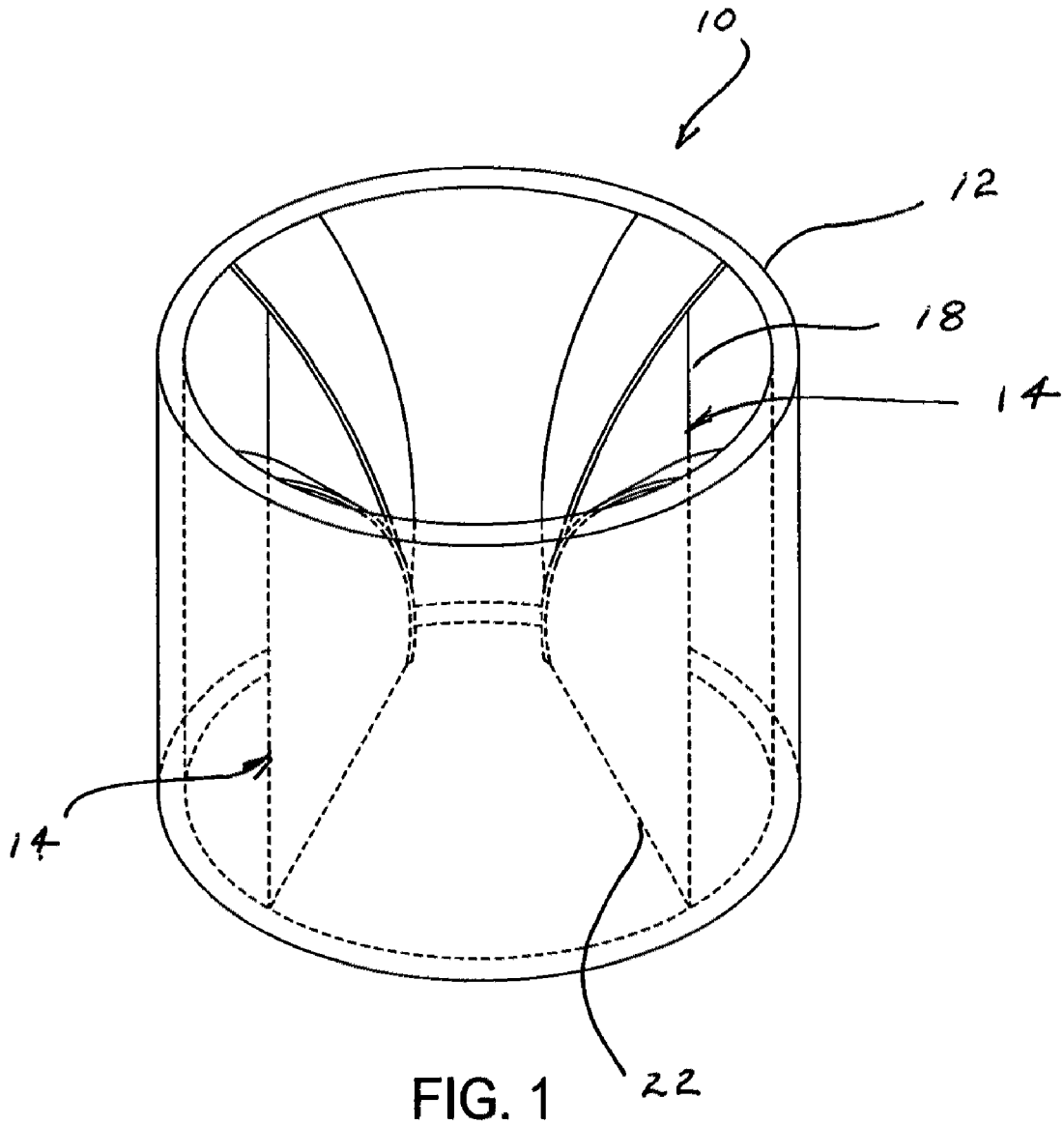
FIG. 1 is a perspective view of a mixing device of the present invention mounted within a pipe section.
Figure 1A:
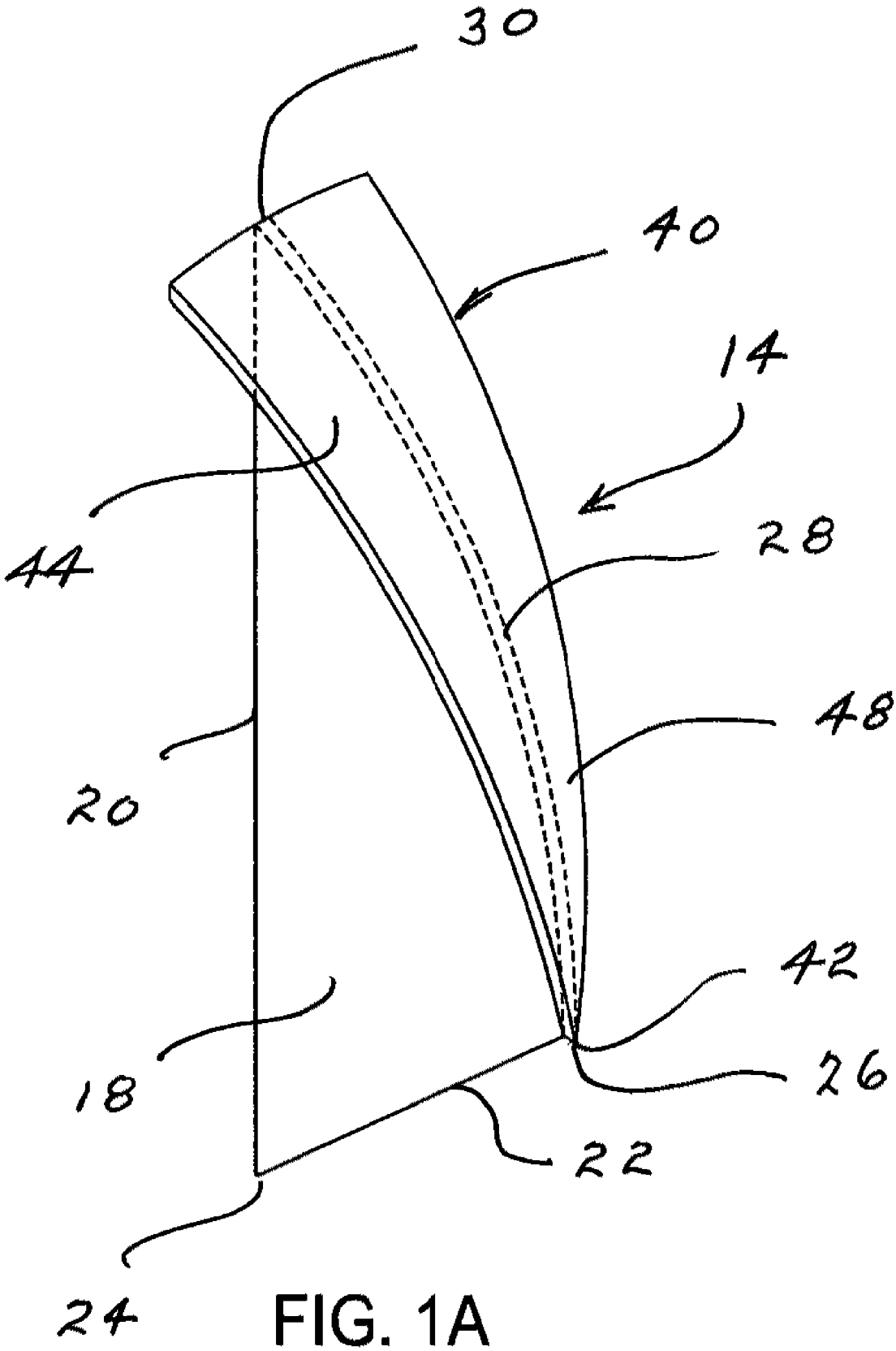
FIG. 1A is a perspective view of one of the individual mixing vanes that are internally disposed within the pipe section shown in FIG. 1.
Figure 2:
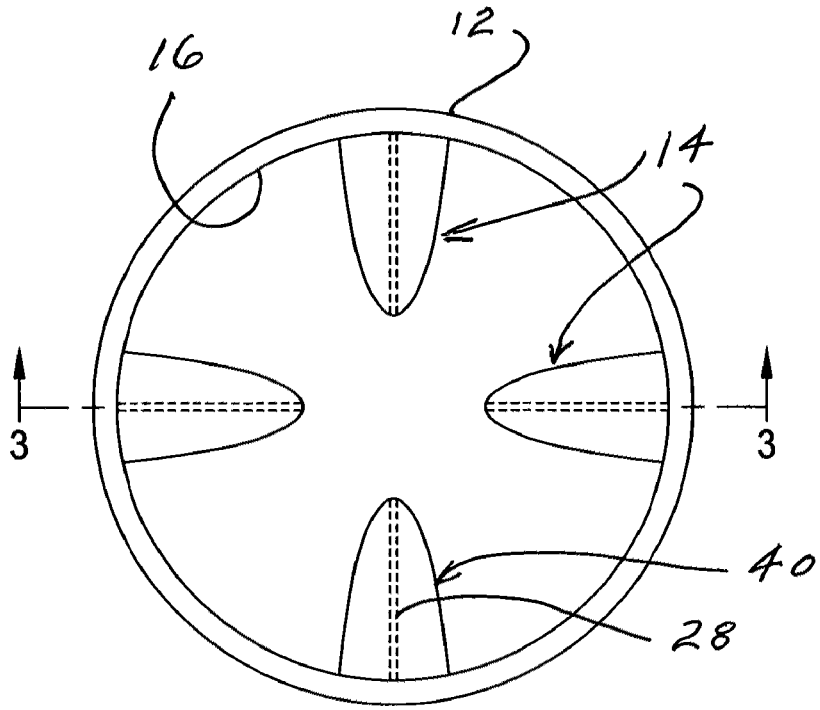
FIG. 2 is a top plan view of FIG. 1.
Figure 3:
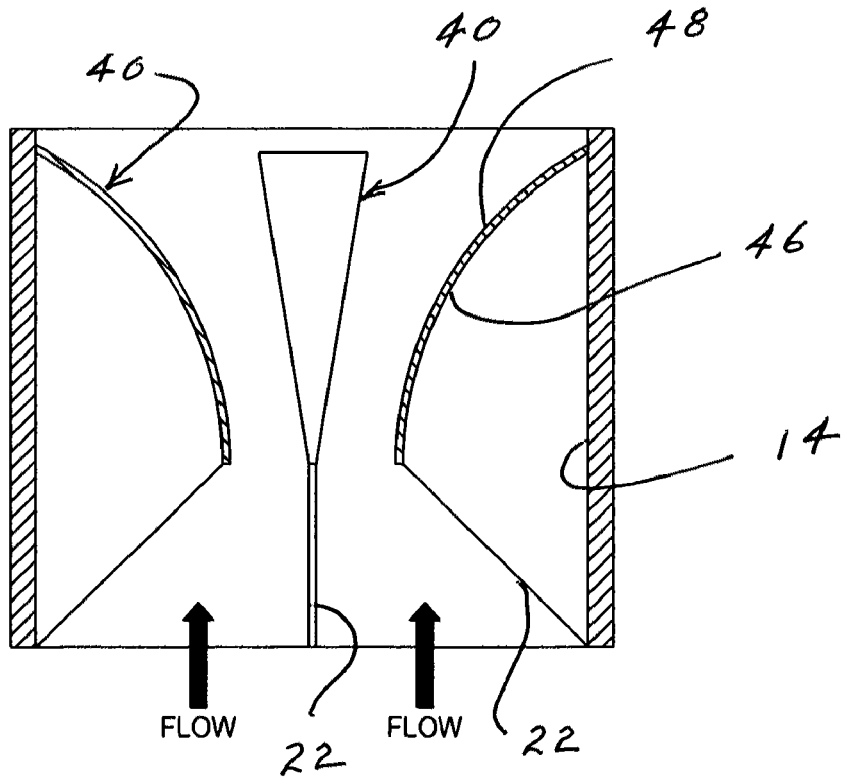
FIG. 3 is a sectional view along the line 3-3 of FIG. 2.
Figure 4:
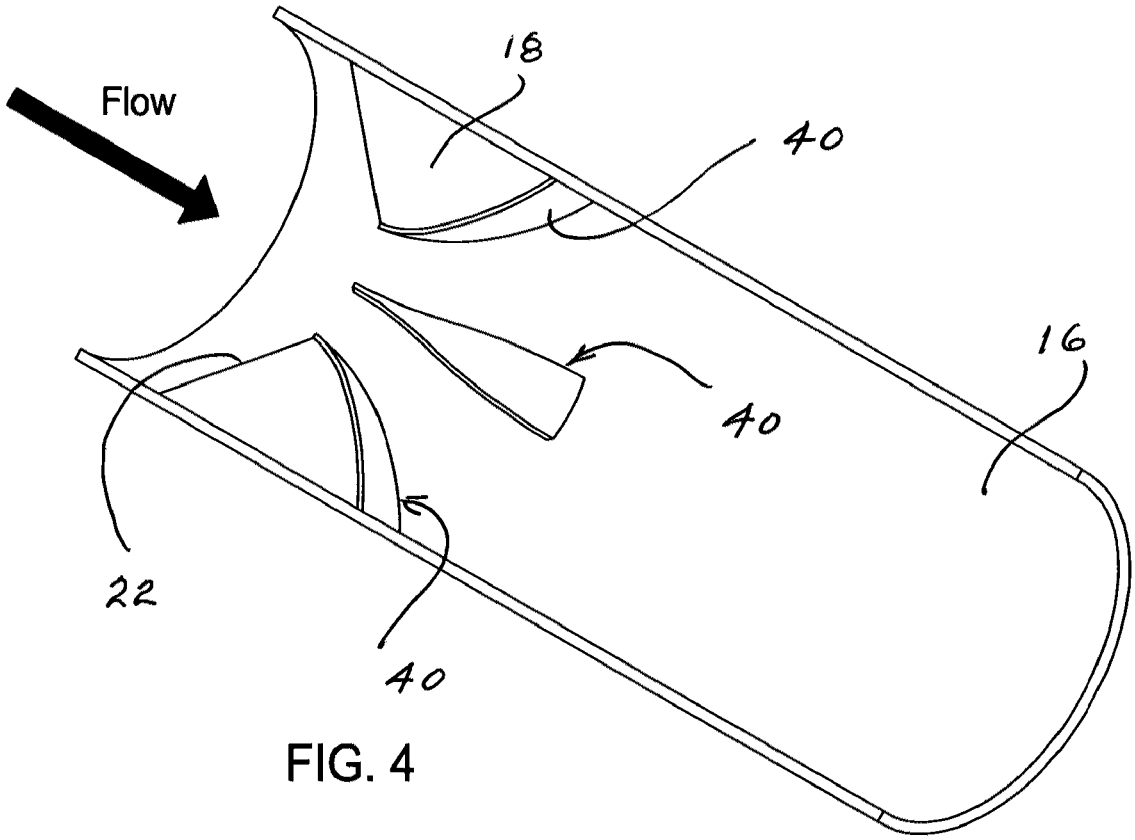
FIG. 4 is a sectional perspective view of the device mounted within a section of pipe.
Figure 5:
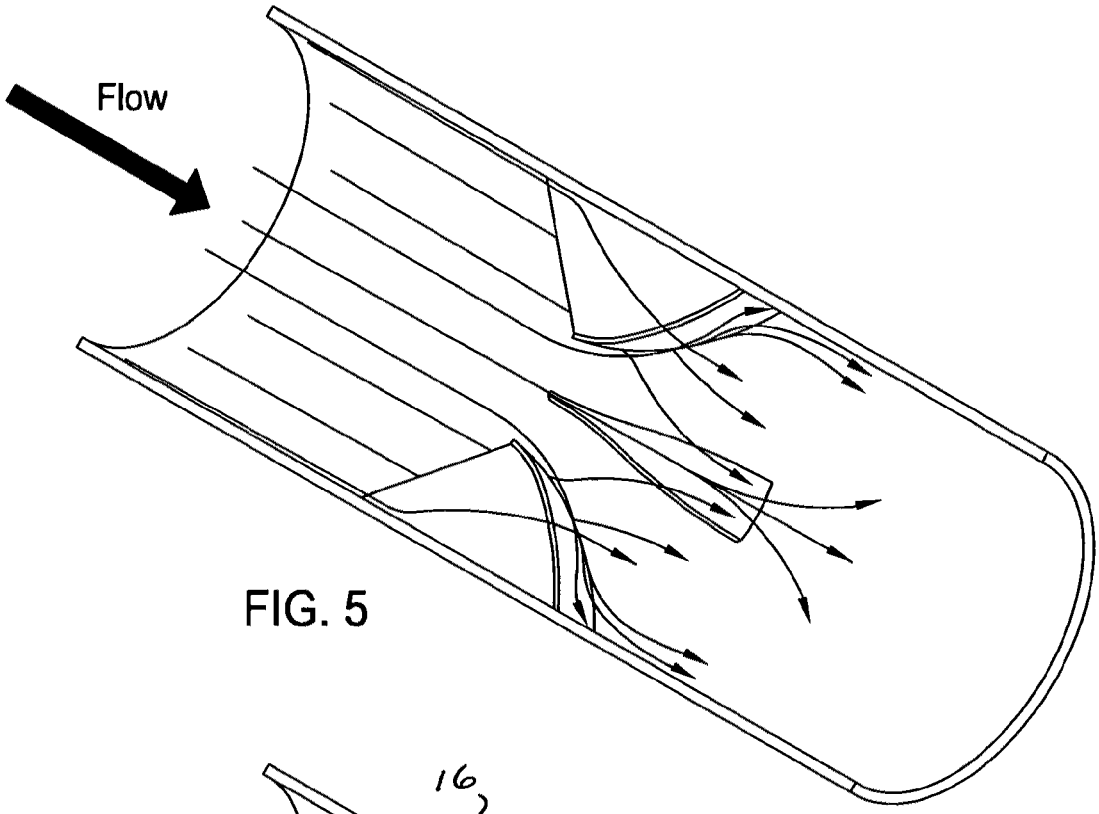
FIG. 5 is a view similar to FIG. 4 but showing the manner in which the fluid flow is diverted upon passing through the device of the present invention.

Turning now to the drawings and particularly FIGS. 1 and 1A, the construction of the mixing device 10 of the present invention is shown mounted within a pipe section 12 that for fabricating convenience and assembly is subsequently mounted in a longer pipe section in which the fluid to be mixed is flowing. Obviously, the mixing device could alternatively be mounted directly within the longer pipe section.

The mixer device 10 includes a plurality of vanes 14 (generally four vanes) spaced equidistantly within the pipe section and extending from the inner pipe section surface wall 16 radially inwardly extending approximately two thirds of the pipe diameter—thus, larger pipes would have larger mixers and vice-versa. The vanes 14 each include a plate member 18 of planer extent with a straight base edge 20 which, in turn, is welded, glued or otherwise attached to the inner pipe wall surface 16 depending on the type material from which the mixer and the pipe in which the mixer is mounted is constructed, e.g., metal such as stainless steel or plastic such as PVC with or without a Teflon coating. The plate members 18 are shaped to resemble an upstanding oblong tab with a leading edge wall 22 extending upwardly and rearwardly from the forward edge 24 of the base edge 20 at an angle of approximately 45 degrees to a plate peak 26 and connecting with a trailing wall 28 that is curved and extends downwardly rearwardly to the rear edge 30 of the base edge 20 so as to complete the shape of each of the plates 18.

Each tab or plate member 18 includes a cap 40 attached to the curved rear edge 28 of the tab. Each cap 40 is generally triangular in shape, that is, the cap has a narrow, i.e., pointed, front and widening wings extending therefrom. The cap could also be somewhat rounded at the front end thereof and such configuration is encompassed by the term "generally triangular". Each cap includes a cap peak 42 from which side edge walls 44 outwardly rearwardly extend and form inner and outer surfaces 46 and 48 respectively. Generally, the caps 40 are fabricated in the flat and then bent to assume the curve shown in the drawings and attached by appropriate welding or gluing techniques to the trailing wall 28 of the plate. Alternatively, each entire plate member could be injection molded in the case of engineered plastics or forged, etc. when utilizing metals.

The above described combination of plate and cap configuration provides a mixing system where fluid flowing within the pipe system initially encounters the plate forward edge so as to be divided into eight (assuming four vanes) streams and thence each of such streams contacts the separate inner wall surfaces 46 of each of the caps 40 and are forced downwardly outwardly into the inner pipe wall surfaces adjacent the trailing end of the mixer. This action, in effect, turns these individual flow streams inside out and dissipates considerable energy from the flow. In addition, contact of the central stream undivided by the forward edges of the vanes creates strong trailing vortices that contribute to effective mixing action.

The objective of this mixer is to achieve a low coefficient of variation (CoV) of the injected fluid within a short distance downstream of the injection point with as little pressure loss as possible. CFD tests were conducted to determine the head loss and mixing capabilities of the leading tab low head mixer of this invention installed in a 6-inch pipe with water flowing at 360 gpm.

Computational Model Description

The model geometry was developed using the commercially available three-dimensional CAD and mesh generation software, GAMBIT V2.4.6. The computational domain generated for the model consisted of approximately 2-3 million hexahedral and tetrahedral cells.

Numerical simulations were performed using the CFD software package FLUENT 12.1—a state of-the-art, finite volume-based fluid flow simulation package including program modules for boundary condition specification, problem setup, and solution phases of a flow analysis. Advanced turbulence modeling techniques, improved solution convergence rates and special techniques for simulating species transport makes FLUENT particularly well suited for this study.

FLUENT was used to calculate the three-dimensional, incompressible turbulent flow through the pipe and around the flow conditioner. A stochastic, anisotropic, two-equation k-e model was used to simulate the turbulence. The anisotropic model was required to properly resolve the secondary flows that developed as a result of changes in geometry. Detailed descriptions of the physical models employed in each of the fluent modules are available from Ansys/Fluent, the developer of Fluent V12.1.

Model Boundary Conditions

The tests were conducted in 6-inch LD steel pipe. It has been determined through previous testing that the mixer performs similarly at different flow rates provided the flow is turbulent—thus, only one water flow rate was tested (360 gpm) at ambient pressure and temperature. A uniform velocity inlet was imposed at the model inlet, which was placed 5-pipe diameters upstream of the mixer inlet with a tracer concentration of 0%. A uniform static pressure boundary condition was imposed at the model outlet, which was placed 10-pipe diameters downstream of the mixer inlet such that the impact of the mixer could be documented as a function of downstream distance. On all surfaces, no-slip impermeable adiabatic wall boundary conditions were applied with roughness heights set to 0.00015-ft as appropriate for steel pipe.

To measure mixing, a 2% solution (7.2 gpm) of a tracer fluid with properties equal to that of water was injected equally into two opposing ⅜" schedule-40 injection nozzles directly upstream of the mixer inlet. The injection nozzles protruded 1 inch into the pipe, or ⅙ of the pipe diameter, or % the height of the mixing tabs. The mixing of the solution was then monitored at 1-pipe diameter, i.e., 6-inch, intervals downstream.

Results and Discussion

The goal of the mixer is to achieve a uniform concentration of the injected material in as short a downstream distance as possible with as little pressure loss as possible.

Pressure loss was measured across the flow conditioner by comparing pressure loss across the test section with and without the conditioner installed. K-values were calculated from the resulting pressure measurements and do not include either the pressure loss for the pipe under normal flow conditions or the resistance from the injection nozzles. The following k-values may be used to calculate the pressure loss contribution of the mixer at other flow conditions.

Westfall 3050 Staged Mixer

| Configuration | k-Value |
|---|---|
| Single Mixer: | 0.58 |
| Double Mixer: | |
| In Line | 1.13 |
| 45° Offset | 1.03 |
| Triple Mixer | |
| In Line | 1.64 |

Mixing was tested in four configurations: a single mixer; a double mixer with subsequent mixing tabs aligned with the flow (in line); a double mixer with subsequent mixing tabs offset by 45°; and a triple mixer with subsequent mixing tabs aligned with the flow (in line). After testing the double mixer, it was found that the in line orientation performed better than the 45° offset orientation. Since in line orientation achieved better performance utilizing the double mixer, only the in line orientation was tested utilizing the triple mixer.

Figure 7:
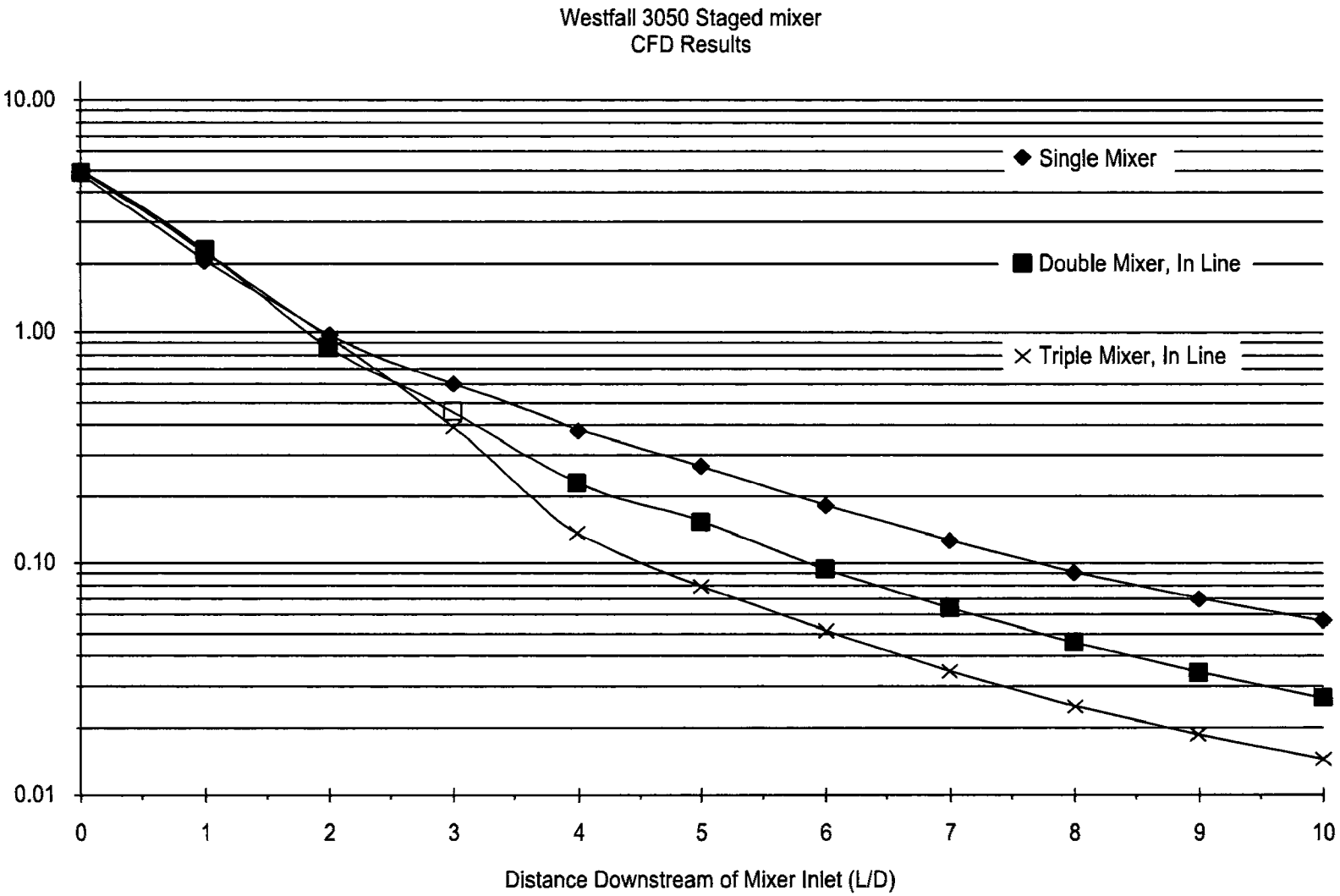
FIG. 7 is a table depicting the results of CFD analysis and showing the results of mixing effectiveness achieved within various downstream distances from the mixer and stated in pipe diameter lengths.
Figure 8:
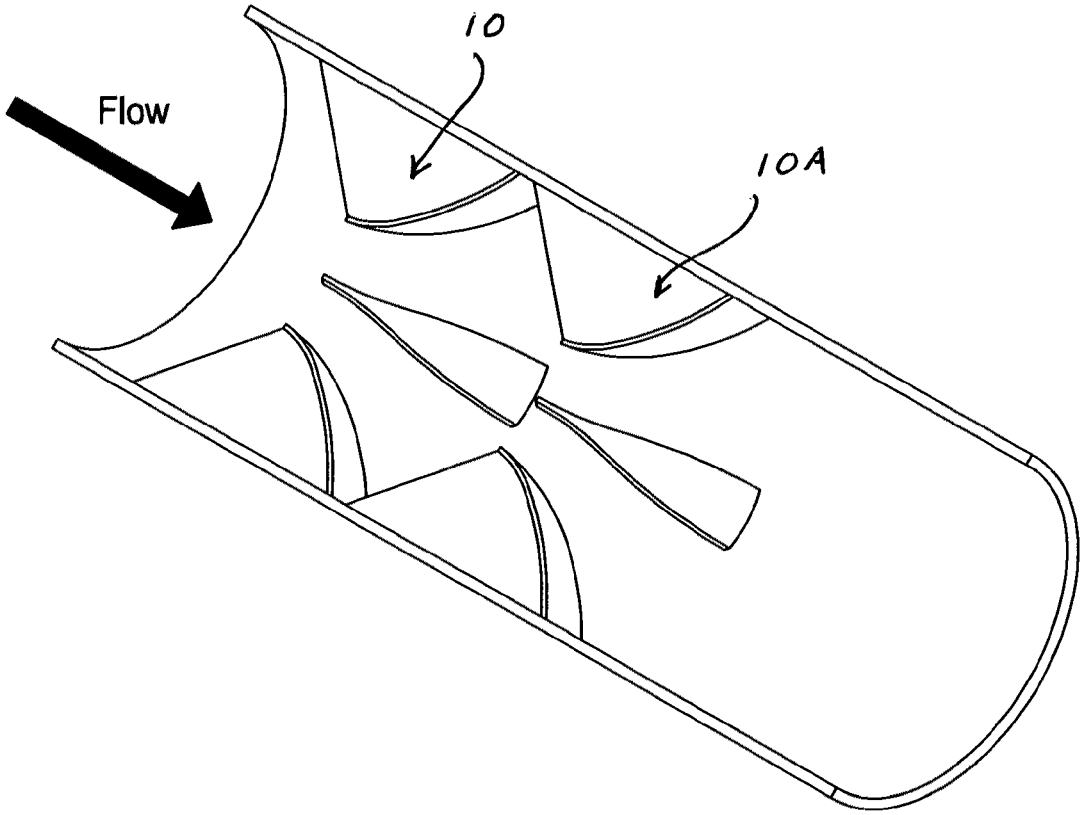
FIG. 8 is a view similar to FIG. 4 but depicting the use of two mixing devices 10 and 10A are longitudinally aligned with each other within the pipe.
Figure 9:
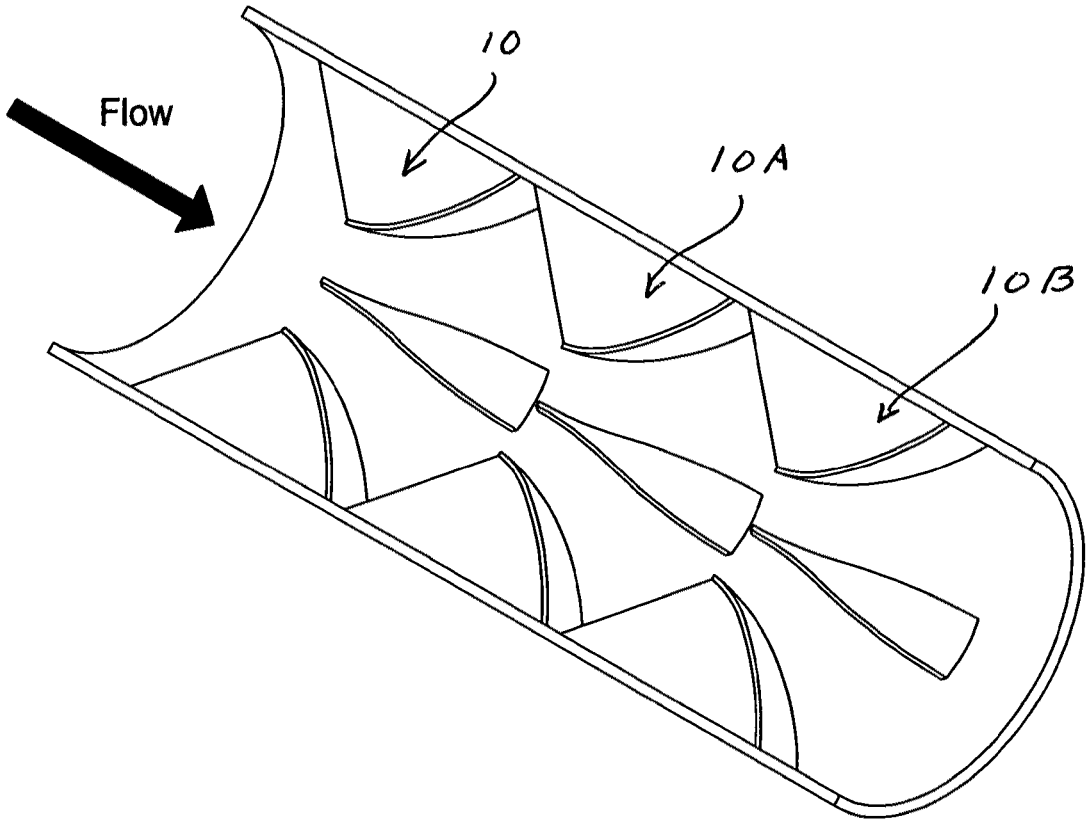
FIG. 9 is a view similar to FIGS. 4 and 8 where three such mixing devices 10, 10A and 10B are longitudinally aligned with each other.

As expected, adding stages to the mixer increased performance with the exception of the double mixer with 45° offset after 7-pipe diameters downstream. A table of CoV values is shown in FIG. 7.

Figure 6:
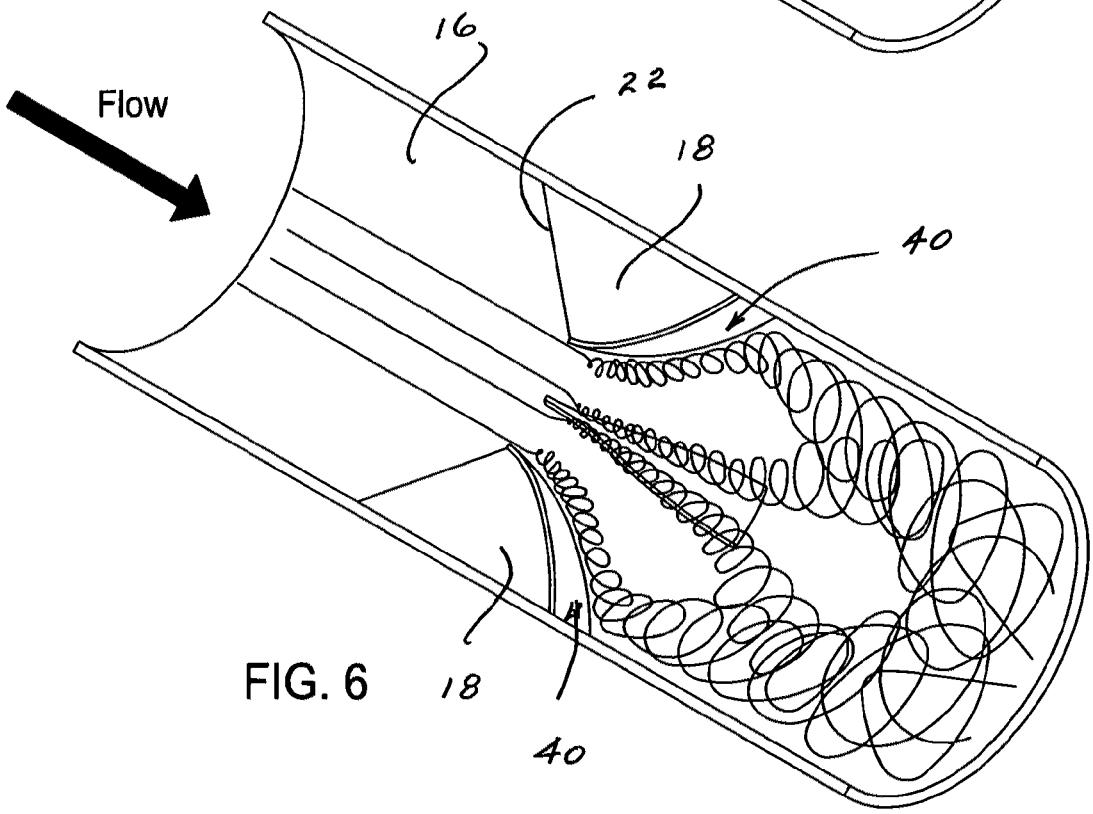
FIG. 6 is a view similar to FIG. 4 and showing the trailing vortices created by the mixing device upon the fluid flow passing through the pipe.

It should be apparent from FIG. 6 that excellent mixing was achieved by the mixing devices of the present invention and that a remarkable decrease in head loss was achieved over the prior art (see FIG. 10).

CONCLUSIONS

With the injection locations described, the mixer of the present invention functions well in low-head applications provided there are a few pipe diameters available downstream for the flow to mix fully. Although the device was originally designed as a flow conditioner, the device of the present invention to is also very effective at mitigating any swirling flow. The low pressure loss characteristics are very desirable for pressure limited operation, and the raked angles of the leading edges prevent fouling.

Adding more mixing devices in line within the conduit increases the mixing performance albeit at the cost of increased pressure loss. Although it is recommended that subsequent mixers be aligned with one another and not offset because offset orientation was found to somewhat impede mixing, offset orientation still produced acceptable results and, accordingly, is encompassed by the attached claims.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination with a hollow tubular conduit defining an internal longitudinal passageway wherein said conduit includes an internal wall surface, a static mixing device positioned in said conduit and within a fluid stream having a longitudinal flow direction with said passageway, comprising a plurality of mixing vane members forming a set thereof, said vanes spaced generally circumferentially equidistantly within said conduit and radially inwardly extending from said conduit internal wall surface towards the center of said conduit, each of said vane members including a generally oblong plate of planar extent with a generally straight base edge attached to said internal conduit wall and further including a leading edge upstanding from a base edge forward portion to a peak from which, in turn, a rearwardly downwardly curved tailing edge extends and terminates proximal the rear portion of said base edge, each of said plates including a generally triangularly-shaped cap attached and conforming to said curved trailing edge thereof with the cap apex aligned with said leading edge peak so as to form cap undersurfaces and cap top surfaces.

2. The device of claim 1, wherein four vane members are provided.

3. The device of claim 1, wherein the leading edge is upwardly rearwardly slanted.

4. The device of claim 1, wherein the longitudinal extent of said vanes is approximately one diameter of said conduit.

5. The device of claim 1, wherein a second set of vane members are positioned downstream of said first set of vane members.

6. The device of claim 5, wherein a third set of vane members are positioned downstream of said second set of vane members.

7. The device of claim 5, wherein said second set of vane members are longitudinally aligned with said first vane member set thereof and the longitudinal extent of each of said vane member sets is approximately one diameter of said conduit.

8. The device of claim 1, wherein said cap undersurfaces directing the fluid flow passing through said conduit against said conduit internal wall surfaces and said cap top surfaces developing trailing vortices in the portion of the fluid flow passing thereover.

* * * * *